US010340103B2

(12) United States Patent
Jameson et al.

(10) Patent No.: US 10,340,103 B2
(45) Date of Patent: Jul. 2, 2019

(54) SWITCHING ASSEMBLIES WITH INTEGRAL HANDLE AND ROTOR AND METHODS OF ASSEMBLY

(71) Applicant: Siemens Industry, Inc., Alpharetta, GA (US)

(72) Inventors: Thomas Jameson, Bellefontaine, OH (US); Alejandro Gabriel Cruz Ruvalcaba, Monterrey (MX)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 73 days.

(21) Appl. No.: 15/702,009

(22) Filed: Sep. 12, 2017

(65) Prior Publication Data

US 2019/0080866 A1 Mar. 14, 2019

(51) Int. Cl.

| | |
|---|---|
| ***H01H 21/36*** | (2006.01) |
| ***H01H 21/22*** | (2006.01) |
| ***H01H 21/04*** | (2006.01) |
| ***H01H 11/00*** | (2006.01) |
| ***H01H 21/12*** | (2006.01) |

(52) U.S. Cl.

CPC ..... *H01H 21/36* (2013.01); *H01H 11/00* (2013.01); *H01H 21/04* (2013.01); *H01H 21/12* (2013.01); *H01H 21/22* (2013.01); *H01H 2205/002* (2013.01)

(58) Field of Classification Search

CPC ..... H01H 21/36; H01H 11/00; H01H 21/04; H01H 21/12; H01H 21/22; H01H 2205/002

USPC ..... 200/336

See application file for complete search history.

(56) References Cited

U.S. PATENT DOCUMENTS

| | | | | | |
|---|---|---|---|---|---|
| 2,134,986 | A | | 11/1938 | Rach | |
| 2,332,633 | A | | 10/1943 | Green | |
| 3,114,024 | A | * | 12/1963 | Tillson | H01H 1/60 200/280 |
| 3,725,624 | A | * | 4/1973 | Emmons | A47J 43/044 200/569 |
| 3,794,792 | A | * | 2/1974 | Wilson | H01H 3/30 185/40 R |
| 4,902,864 | A | * | 2/1990 | Markowski | H01H 21/42 200/329 |
| 5,609,245 | A | * | 3/1997 | Cassity | H01H 3/04 200/254 |
| 6,313,416 | B1 | * | 11/2001 | Abroy | H01H 1/42 200/15 |
| 9,460,867 | B2 | * | 10/2016 | Gottschalk | H01H 1/00 |
| 2010/0078299 | A1 | * | 4/2010 | Mruthunjaya | H01H 1/226 200/244 |

* cited by examiner

*Primary Examiner* — Edwin A. Leon

(57) ABSTRACT

An electrical switching assembly. The electrical switching assembly includes an integral handle and rotor unit including an integral rotor portion and a handle portion. The rotor portion is configured to receive one or more conductors and is configured to be received in a line base. Assembly methods for electrical switching assemblies are provided, as are other aspects.

20 Claims, 6 Drawing Sheets

SWITCHING ASSEMBLIES WITH INTEGRAL HANDLE AND ROTOR AND METHODS OF ASSEMBLY

FIELD

The present disclosure relates to switching assemblies and methods of assembling switching assemblies.

BACKGROUND

Electrical switching assemblies include a line base electrically coupled between a line and a load. A rotor is received in the line base and electrically couples or decouples the line and load depending on the rotational orientation of the rotor. A separate handle is attached to the rotor to enable a user to rotate the rotor. Several mechanisms attach the handle to the rotor to maintain the rotor in fixed positions, such as a position where the rotor electrically couples the line and load together.

These complex mechanisms increase the complexity and cost of switching assemblies. In addition, the complex mechanisms increase the assembly time of such switching assemblies.

Accordingly, there is a need for switching assemblies without the complex mechanisms and that may be more rapidly assembled.

SUMMARY

According to a first aspect, an electrical switching assembly is provided. The electrical switching assembly includes an integral handle and rotor unit including a rotor portion integral with a handle portion, the rotor portion configured to receive one or more conductors, and the rotor portion configured to be received in a line base.

In accordance with another aspect, an electrical switching assembly is provided. The electrical switching assembly includes an enclosure including an interior and an enclosure opening extending between the interior and an exterior of the enclosure, an integral handle and rotor unit including a rotor portion integral with a handle portion, the rotor portion being received in the enclosure opening, one or more conductors extending radially through the rotor portion, one or more orientation features on the rotor portion, a line base within the interior of the enclosure including one or more line base openings configured to receive the one or more orientation features when the integral handle and rotor unit is oriented in a predetermined position relative to the line base, wherein the rotor portion is configured to be rotatable about a central axis when the rotor portion is received within the one or more line base openings, and one or more terminals in the line base, wherein the one or more terminals are configured to contact the one or more conductors in response to rotation of the rotor portion.

In accordance with another aspect, a method of assembling an electrical switching assembly is provided. The method includes providing an integral handle and rotor unit including a handle portion integral with a rotor portion, the rotor portion including one or more holes extending through the rotor portion, providing a line base including one or more openings configured to receive the rotor portion, providing one or more electrical terminals within the line base, rotating the rotor portion to a first position, wherein the rotor portion is receivable in the one or more openings when the rotor portion is in the first position, inserting the rotor portion into the line base, and inserting a conductor into at least one of the one or more openings in the rotor portion, wherein each conductor is configured to contact the one or more electrical terminals in response to rotation of the rotor portion.

Still other aspects, features, and advantages of the present disclosure may be readily apparent from the following detailed description by illustrating a number of example embodiments and implementations, including the best mode contemplated for carrying out the disclosure. The disclosure may also be capable of other and different embodiments, and its several details may be modified in various respects, all without departing from the scope of the present disclosure. Accordingly, the drawings and descriptions are to be regarded as illustrative in nature, and not as restrictive. The disclosure is to cover all modifications, equivalents, and alternatives falling within the scope of the claims.

BRIEF DESCRIPTION OF THE DRAWINGS

The drawings described below are for illustrative purposes and are not restrictive. The drawings are not necessarily drawn to scale and are not intended to limit the scope of this disclosure in any way.

DETAILED DESCRIPTION

Figure 1A:
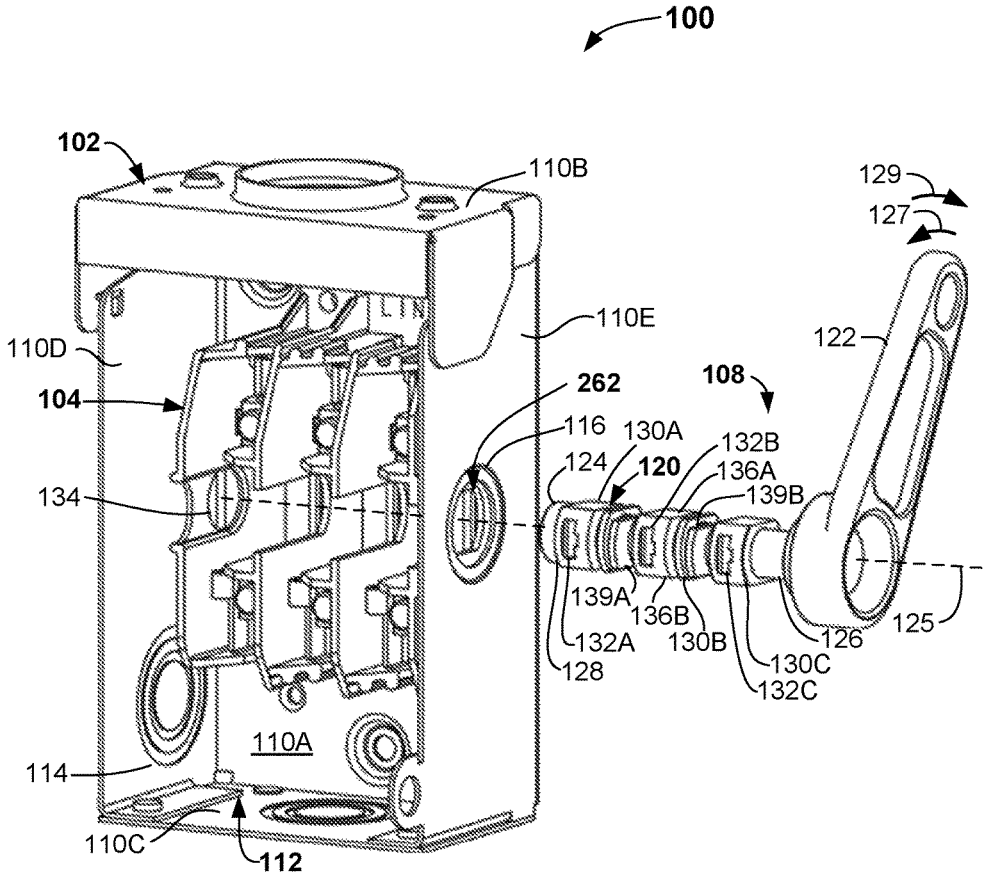
FIG. 1A illustrates an isometric view of a switching assembly including an integral handle and rotor unit removed from an enclosure according to embodiments.

Embodiments of the present disclosure concern providing improved switching assemblies and improved methods of assembling switching assemblies.

Traditional switching assemblies include a line base located within a box-like enclosure. Line and load conductors are electrically coupled to the line base. A rotor is located within the line base and electrically couples and decouples the line and load. For example, the rotor may rotate to an ON state and electrically couple the line and load together. The rotor may also rotate to an OFF state and decouple the line from the load.

Traditional switching assemblies include a handle that is attached to the rotor by attachment mechanisms and enables a user to manually rotate the rotor by moving the handle. In addition to the separate handle and rotor, traditional switching assemblies include retaining mechanisms that retain the rotor in predetermined positions or states, such as the ON state and the OFF state.

Assembly of a traditional switching assembly is complicated due, in part, to the attachment of the handle to the rotor and assembly of the retaining mechanisms. For example, the retaining mechanisms may be assembled within tight confines of an enclosure that holds the line base. The handle may then be attached to the rotor, which further increases assembly time.

The switching assemblies disclosed herein provide improved switching assemblies and methods of assembling switching assemblies. For example, the switching assemblies may include an integral (e.g., one-piece) handle and rotor unit. Accordingly, the rotor and handle do not have to be assembled. The rotor may include one or more orientation features that enable it to be received in a predetermined position within the line base. The orientation features may further retain the rotor within the line base. Thus, no retaining mechanisms may be included in the switching assemblies.

These and other embodiments of the switching assemblies and methods of assembling switching assemblies according to the present disclosure are described below with reference to FIGS. 1A-5 herein. Like reference numerals used in the drawings identify similar or identical elements throughout the several views. The drawings are not necessarily drawn to scale.

Referring now to FIG. 1A, a switching assembly 100 including an enclosure 102, a line base 104 and an integral handle and rotor unit 108 is shown and described. The integral handle and rotor unit 108 may be referred to herein as, "handle rotor unit." The handle rotor unit 108 is shown removed from the enclosure of FIG. 1A. The enclosure 102 may include a back wall 110A, a top wall 1106, a bottom wall 110C opposite the top wall 1106, a first side wall 110D, and a second side wall 110E opposite the first side wall 110D. The enclosure 102 may include an opening 112 to an interior 114. A door (not shown) may cover the opening 112. The enclosure 102 may be made of metal, plastic, or other rigid materials.

The second side wall 110E may include an opening 116 extending between the interior 114 and exterior of the enclosure 102 and sized to receive a rotor portion 120 of the handle rotor unit 108. The rotor portion 120 may be referred to herein as the "rotor 120." The opening 116 may be configured to enable the rotor 120 to rotate or pivot within the opening 116. The line base 104 may be coupled to the back wall 110A of the enclosure 102 so as to enable the rotor 120 to be received in portions of the line base 104 as described herein. A handle portion 122 of the handle rotor unit 108 may be integral with the rotor 120 and may be located exterior to the enclosure 102 when the rotor 120 is received in the opening 116. The handle portion 122 may be referred to herein as "handle 122." The handle 122 may enable a user to rotate the rotor 120 by manually moving the handle 122. The handle rotor unit 108 may be made of a rigid insulting material, such as rigid plastic or other such material. The handle rotor unit 108 may be molded as a single unit or formed from a single rigid insulating material.

The rotor 120 may include a first end 124 and an opposite second end 126 that may be integrally formed with or into the handle 122. The first end 124 may include an extension 128 that may be configured to pass through the opening 116 and be received in a bore 134 in the line base 104 as described herein. The extension 128 may be cylindrical and may be rotatable or pivotable within the bore 134. The rotor 120 may be rotatable about a central axis 125 extending between the first end 124 and the second end 126 when the rotor 120 is received within the line base 104. The rotor 120 may be movable in a first direction 127 and a second direction 129 by movement of the handle 122.

Figure 1B:
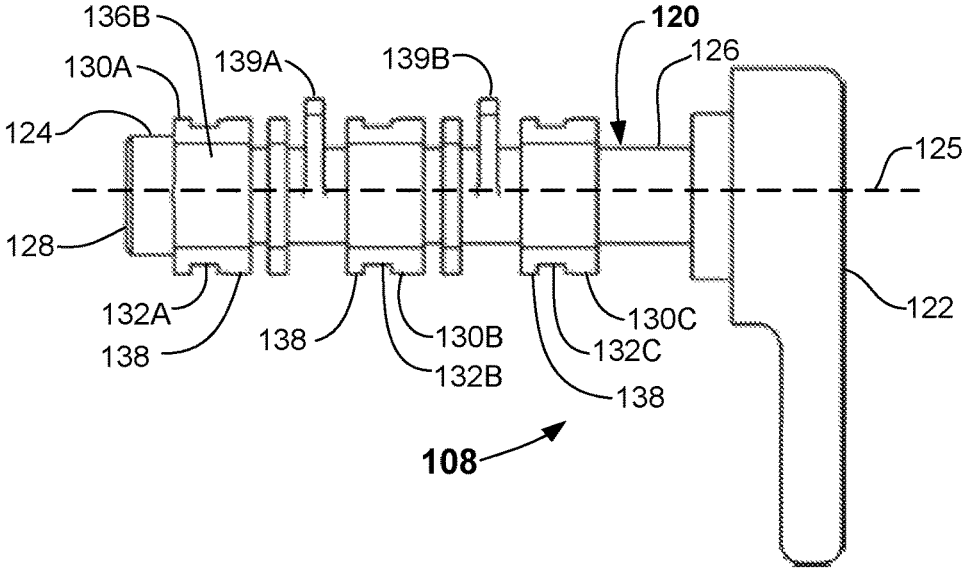
FIG. 1B illustrates a side view of an integral handle and rotor unit according to embodiments.
Figure 1C:
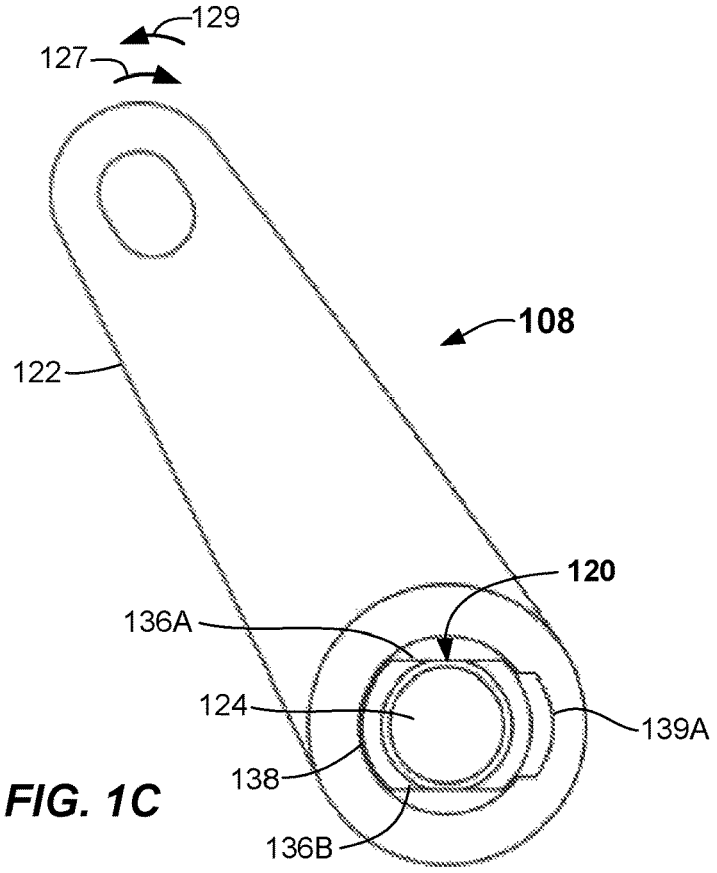
FIG. 1C illustrates an end view of an integral handle and rotor unit according to embodiments.

Additional reference is now made to FIGS. 1B and 1C. FIG. 1B illustrates a side view of the handle rotor unit 108 and FIG. 1C illustrates an end view of the handle rotor unit 108. The rotor 120 may include one or more segments between the first end 124 and the second end 126. The rotor 120 shown in FIG. 1 includes three segments, a first segment 130A, a second segment 130B, and a third segment 130C. The number of segments may be the same as the number of electrical phases of the switching assembly 100. For example, the switching assembly 100 may be a three phase switch, with one segment associated with each phase. In some embodiments, the rotor 120 may have one or more segments, with each segment corresponding to a phase of the switching assembly 100. Each segment may include a hole extending through the rotor 120 that is sized to receive and retain a conductor described below. For example, the first segment 130A may include a first hole 132A, the second segment 130B may include a second hole 132B, and the third segment 130C may include a third hole 132C.

The rotor 120 may include one or more orientation features that enable the rotor 120 to be received within the line base 104 when the rotor 120 is in a predetermined orientation relative to the line base 104. The rotor 120 shown in FIGS. 1A-1C may include orientation features including a first flat surface 136A and a second flat surface 136B. The first flat surface 136A and the second flat surface 136B may extend the length of the rotor 120 between the first end 124 and the second end 126. The segments 130A-130C may each include a surface extending between the first flat surface 136A and the second flat surface 136B. For example, a surface 138 (e.g., a curved surface) may extend between the first flat surface 136A and the second flat surface 136B on all the segments 130A-130C. The surface 138 is shown in FIGS. 1B and 1C as being curved, but it may have any shape. The orientation features may further include a first lobe 139A and a second lobe 139B extending radially from the rotor 120. The first lobe 139A and the second lobe 139B may be identical and may extend radially further than the distance of the segments 130A-130C. The first lobe 139A and the second lobe 139B may extend further from the rotor 120 than other elements of the rotor 120. In some embodiments, the rotor 120 includes one or more lobes. Different orientation features including shapes other than those described herein may be implemented in the rotor 120.

Figure 2A:
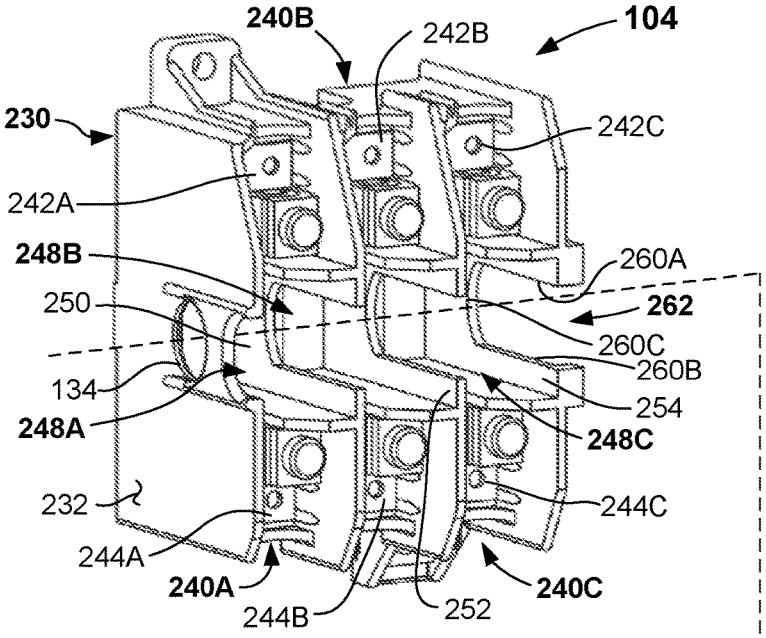
FIG. 2A illustrates a line base with a handle and rotor unit removed therefrom according to embodiments.
Figure 2B:
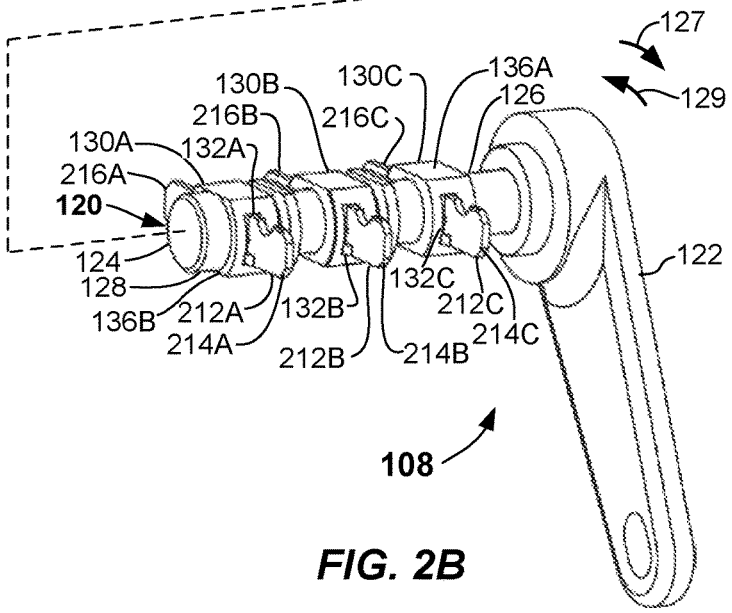
FIG. 2B illustrates an integral handle and rotor unit removed from a line base according to embodiments.

Reference is now made to FIGS. 2A and 2B. FIG. 2A shows an embodiment of the line base 104 with the handle rotor unit 108 removed therefrom. FIG. 2B shows an embodiment of the handle rotor unit 108 removed from the line base 104. One or more conductors extend through the holes 132A-132C. The one or more conductors may be referred to herein as, "blades". In some embodiments, the blades may be configured to conduct 30 amperes. In other embodiments, the blades may be configured to conduct 30 amperes or less. The rotor 120 shown in FIG. 2B includes a first blade 212A extending through the first hole 132A, a second blade 212B extending through the second hole 132B, and a third blade 212C extending through the third hole 132C. The blades 212A-212C may be retained within the holes 132A-132C by clips (not shown) extending from the blades 212A-212C and engaging retainers (not shown) in the holes 132A-132C. In some embodiments, adhesives may be used to retain the blades 212A-212C within the holes 132A-132C.

Each blade may include a first end and a second end, wherein current may conduct between the first ends and the second ends. The first blade 212A may include a first end 214A and a second end 216A, the second blade 212B may include a first end 214B and a second end 216B, and the third blade 212C may include a first end 214C and a second end 216C. In some embodiments, the blades 212A-212C are not placed within the holes 132A-132C until after the rotor 120 is received within the line base 104 as described herein. The blades 212A-212C may be made of rigid conductive materials, such as metal.

The line base 104 may include a housing 230 that may be made of molded plastic or the like. In some embodiments, the housing 230 is made of an insulating rigid material. The housing 230 may have a first wall 232 with the bore 134 extending through the first wall 232. The bore 134 may be sized and configured to receive the extension 128 of the first end 124 of the rotor 120 and to enable the extension 128 to pivot or rotate in the bore 134.

The line base 104 may include one or more segments, wherein current may conduct through the segments depending on the orientation of the rotor 120 as described herein. The line base 104 shown in FIG. 2A includes a first segment 240A, a second segment 240B, and a third segment 240C. The number of segments in the line base 104 may be equal to the number of segments the rotor 120. Each segment may include two electrical terminals that are electrically connected or electrically disconnected from each other depending on the orientation of the rotor 120. The first segment 240A may include a first electrical terminal 242A and a second electrical terminal 244A, the second segment 240B may include a first electrical terminal 242B and a second electrical terminal 244B, and the third segment 240C may include a first electrical terminal 242C and a second electrical terminal 244C.

Each of the segments 240A-240C may include a space between the terminals and bounded by walls, wherein the spaces are sized to receive the segments 130A-130C of the rotor 120 and enable to the segments 130A-130C to rotate therein. The first segment 240A may include a first space 248A bounded by the first wall 232 and a second wall 250. The second segment 240B may include a second space 248B bounded by the second wall 250 and a third wall 252. The third segment 240C may include a third space 248C bounded by the third wall 252 and a fourth wall 254. The segments 130A-130C of the rotor 120 may be confined within the spaces 248A-248C during operation of the switching assembly 100, which prevents the rotor 120 from being removed from the line base 104.

The second wall 250, the third wall 252, and the fourth wall 254 may include first surfaces 260A and second surfaces 260B (shown on the fourth wall 254). The first surfaces 260A and the second surfaces 260B may be spaced a distance that is slightly greater than the distance between the first flat surface 136A and the second flat surface 1366 of the rotor 120. Third surfaces 260C may extend between the first surfaces 260A and the second surfaces 260B. The third surfaces 260C may have radii or profiles that match the surface 138 of the rotor 120.

The surfaces 260A-260C may form one or more openings 262 that receive the one or more orientation features on the rotor 120 or that receive the rotor 120. The orientation features enable the rotor 120 to be received within the line base 104 when the handle rotor unit 108 is oriented as shown in FIG. 1A. Specifically, the first lobe 139A and the second lobe 139B are oriented away from the third surfaces 260C to prevent the rotor 120 from being received within the line base 104 unless the rotor 120 is aligned as shown in FIG. 1A. For example, the first lobe 139A and the second lobe 139B do not fit in the openings 262 formed by the surfaces 260A-260C unless the rotor 120 is oriented so that the first lobe 139A and the second lobe 139B face away from the third surfaces 260C. The orientation features prevent the handle rotor unit 108 from being received within the line base 104 when the handle rotor unit 108 has any other orientation relative to the line base 104. Different configurations of the surfaces 260A-260C of the line base 104 and corresponding configurations of the surfaces 136A, 1366, 138 and the lobes 139A and 1396 on the rotor 120 may be used as different orientation features.

Figure 3:
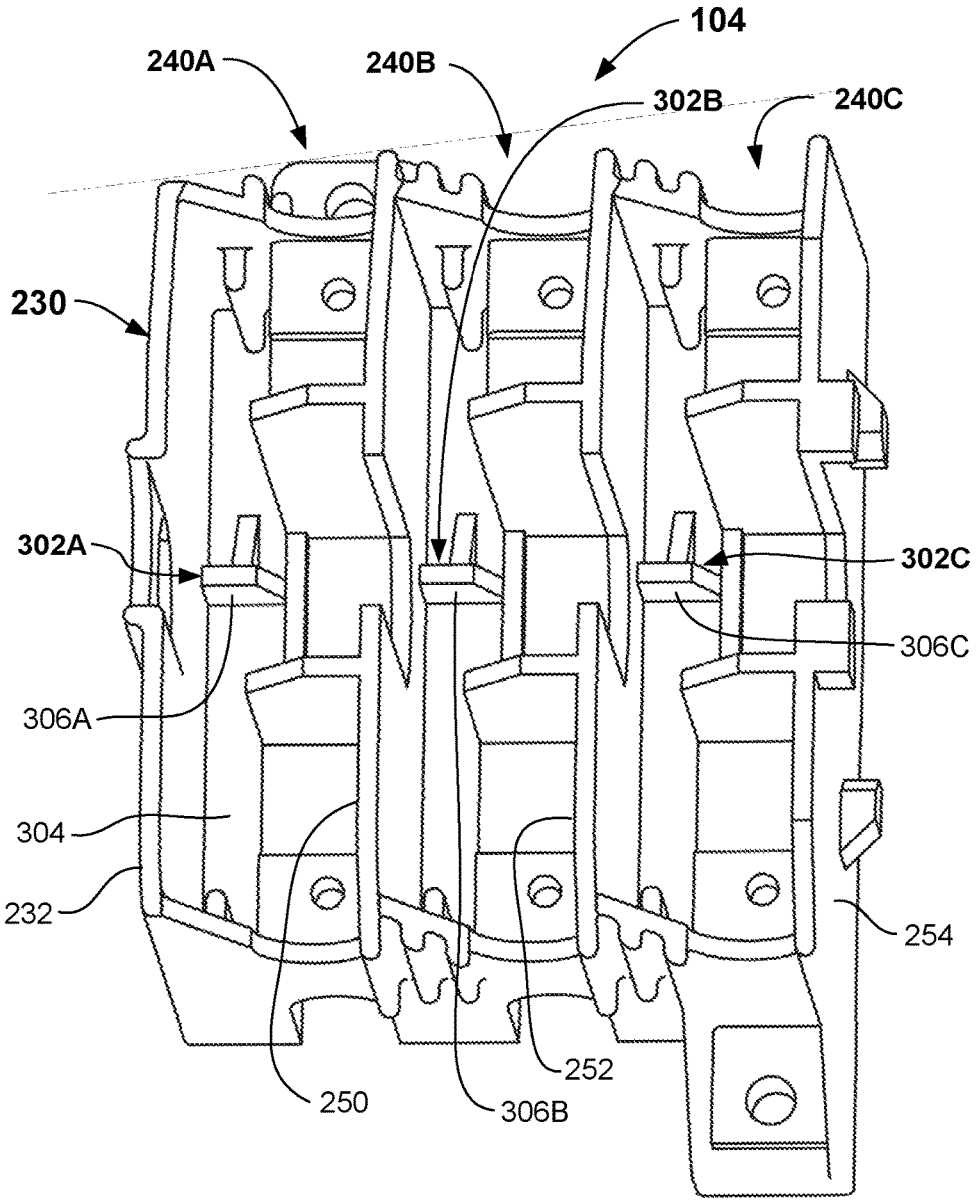
FIG. 3 illustrates an isometric view of a housing of a line base with electrical terminals removed according to embodiments.

Reference is now made to FIG. 3, which illustrates an isometric view of the housing 230 of the line base 104 with the electrical terminals removed. A first stop 302A may be affixed to a back wall 304 in the first segment 240A, a second stop 302B may be affixed to the back wall 304 in the second segment 240B, and a third stop 302C may be affixed to the back wall 304 in the third segment 240C. The first stop 302A may include a surface 306A, the second stop 302B may include a surface 306B, and the third stop 302C may include a surface 306C. The stops 302A-302C and the surfaces 306A-306C may be positioned and configured so that the second ends 216A-216C (FIG. 2B) of the blades 212A-212C contact the surfaces 306A-306C to prevent the rotor 120 from rotating past a predetermined orientation relative to the line base 104. For example, the stops 302A-302C may prevent the handle rotor unit 108 from rotating in the first direction 127 (FIG. 1A) past a predetermined position.

A method of assembling the switching assembly 100 will now be described. Referring again to FIG. 1, the line base 104 may be coupled to the back wall 110A of the enclosure 102. The fourth wall 254 (FIG. 2A) of the line base 104 may abut the second side wall 110E of the enclosure and the opening 116 may align with the openings 262. The handle rotor unit 108 may be oriented as shown in FIG. 1A. Specifically, the rotor 120 may be oriented such that the rotor 120 is receivable through the opening 116 and into the line base 104. The extension 128 may be received in the bore 134. This position of the handle rotor unit 108 may be referred to as an inverted position and in some embodiments is not an operating position of the handle rotor unit 108.

The handle rotor unit 108 may then be rotated in the first direction 127 to a position as shown in FIG. 2B or a similar position. The segments 130A-130C may abut the walls 232, 250, 252, and 254 to prevent the handle rotor unit 108 from being removed from the enclosure 102 by way of the opening 116.

Figure 4:
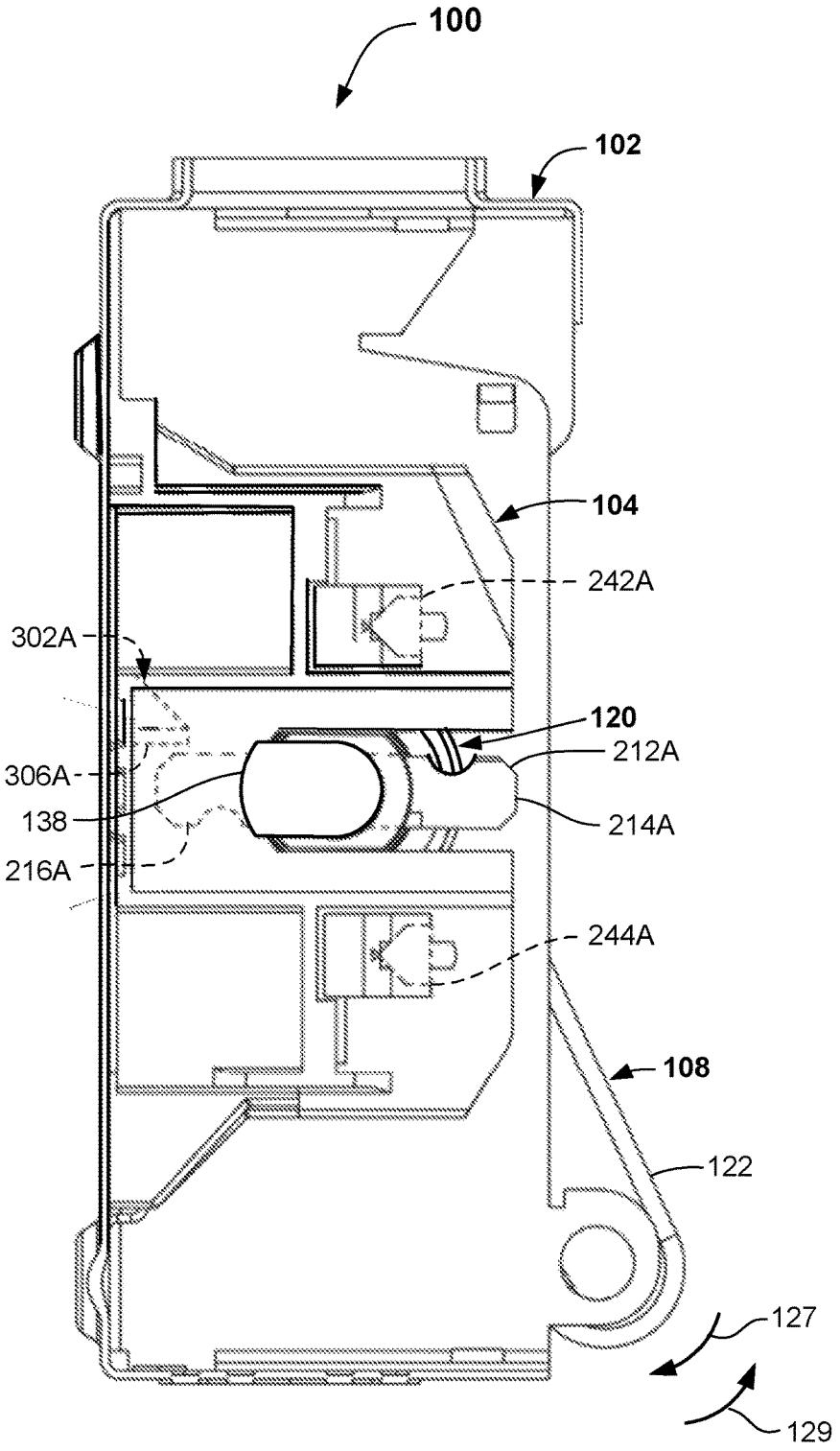
FIG. 4 illustrates a cutaway view of an enclosure and a line base with a blade received in an integral handle rotor unit according to embodiments.

The blades 212A-212C may be inserted into the holes 132A-132C. Clips or other retaining mechanisms (not shown) may be located on the blades 212A-212C and/or in the holes 132A-132C to retain the blades 212A-212C in the holes 132A-132C. Reference is made to FIG. 4, which shows a cutaway view of the enclosure 102 and the line base 104 with the first blade 212A received in the rotor 120. The handle rotor unit 108 has been rotated in the first direction 127 to a position that may be referred to as an OFF position of the switching assembly 100. All the blades 212A-212C (FIG. 2B) may be received within the rotor 120 when the handle rotor unit 108 is in the OFF position. The second end 216A of the first blade 212A shown in FIG. 4 will contact the surface 306A of the first stop 302A if the handle rotor unit 108 is rotated further in the first direction 127. Accordingly, the stops 302A-302C (FIG. 3) and the second ends 216A-216C of the blades 212A-212C prevent further movement of the handle rotor unit 108 past a predetermined position.

The handle rotor unit 108 may be rotated in the second direction 129 to change the state of the switching assembly 100 to an ON state. In the ON state, the first end 214A of the first blade 212A electrically contacts the first electrical terminal 242A and the second end 216A of the first blade 212A electrically contacts the second electrical terminal 244A. These contacts prevent the rotor 120 from rotating past a predetermined position that constitutes an ON state of the switching assembly 100. These contacts enable current flow between the first electrical terminals 242A-242C and the second electrical terminals 244A-244C through the blades 212A-212C.

The switching assembly 100 may be assembled without complex springs and other mechanisms that maintain the rotor in fixed positions. Rather, the orientation features and/or segments 130A-130C may maintain the handle rotor unit 108 within the line base 104. In addition, the handle rotor unit 108 may be integral, such as integrally formed, so the switching assembly 100 does not require additional assembly procedures related to assembling a rotor to a handle. An integral handle rotor unit includes a handle and a rotor that is a one-piece assembly, including assemblies formed from a mold or from a single piece of material, such as a single piece of insulating plastic.

Figure 5:
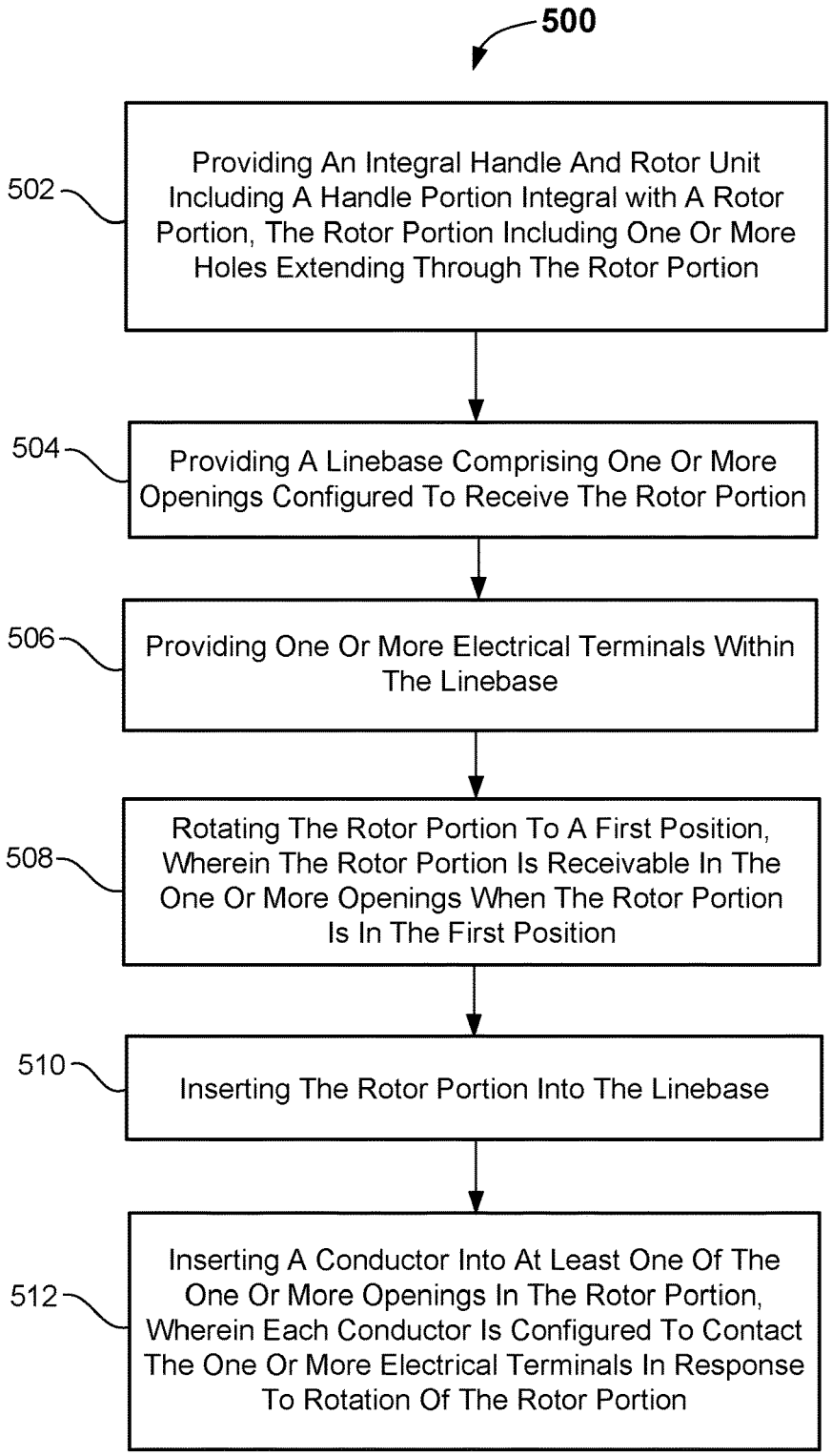
FIG. 5 illustrates a flowchart describing a method of assembling a switching assembly according to embodiments.

In another aspect, a method of assembling a switching assembly (e.g., switching assembly 100) is provided as shown by a flowchart 500 of FIG. 5. The method may include, in 502, providing an integral handle and rotor unit (e.g., handle rotor unit 108) comprising a handle portion (e.g., handle 122) and a rotor portion (e.g., rotor 120). The rotor portion may include one or more holes (e.g., holes 132A-132C) extending through the rotor portion.

The method may include, in 504, providing a line base (e.g., line base 104) comprising one or more openings (e.g., openings 262) configured to receive the rotor portion. The method may include, in 506, providing one or more electrical terminals (e.g., electrical terminals 242A-242C and 244A-244C) within the line base. The method may include, in 508, rotating the rotor portion to a first position, wherein the rotor portion is receivable in the one or more openings when the rotor portion is in the first position. The method may include, in 510, inserting the rotor portion into the line base. The method may include, in 512, inserting a conductor (e.g., blades 212A-212C) into at least one of the one or more openings in the rotor portion, wherein each conductor is configured to contact the one or more electrical terminals in response to rotation of the rotor portion.

The foregoing description discloses example embodiments of the disclosure. Modifications of the above disclosed apparatus and methods which fall within the scope of the disclosure will be readily apparent to those of ordinary skill in the art.

While the disclosure is susceptible to various modifications and alternative forms, specific embodiments and methods thereof have been shown by way of example in the drawings and are described in detail herein. It should be understood, however, that it is not intended to limit the disclosure to the particular apparatus, systems or methods disclosed, but, to the contrary, the disclosure is to cover all modifications, equivalents and alternatives falling within the scope of the disclosure.

What is claimed is:

1. An electrical switching assembly, comprising:

an integral handle and rotor unit including a rotor portion integral with a handle portion;

one or more orientation features on the rotor portion; and a line base comprising one or more openings configured to receive the one or more orientation features, wherein the one or more orientation features enable the rotor portion to be received within the line base when the rotor portion is in a predetermined orientation relative to the line base, wherein the one or more orientation features are configured to retain the rotor portion within the line base without needing any additional retaining mechanisms in the electrical switching assembly, wherein the rotor portion configured to receive one or more conductors, and wherein the rotor portion configured to be received in the line base.

2. The electrical switching assembly of claim 1, comprising:

one or more conductors extending radially through the rotor portion, wherein the rotor portion is configured to be rotatable about a central axis when the rotor portion is received within the one or more openings; and one or more terminals in the line base, wherein the one or more conductors are configured to electrically contact the one or more terminals in response to rotation of the rotor portion.

3. The electrical switching assembly of claim 2, wherein one or more orientation features includes one or more curved portions extending from the rotor portion.

4. The electrical switching assembly of claim 2, wherein one or more orientation features includes a first flat surface.

5. The electrical switching assembly of claim 2, wherein one or more orientation features includes a first flat surface and a second flat surface.

6. The electrical switching assembly of claim 5, wherein the first flat surface is parallel to the second flat surface.

7. The electrical switching assembly of claim 2, wherein the one or more orientation features includes one or more lobes extending from the rotor portion.

8. The electrical switching assembly of claim 7, wherein one or more lobes extend further from the rotor portion than other elements of the rotor portion.

9. The electrical switching assembly of claim 2, wherein the line base comprises one or more stops configured to contact the one or more conductors extending through the rotor portion in response to the integral handle and rotor unit rotating to a predetermined position.

10. The electrical switching assembly of claim 2, wherein the one or more orientation features are configured to prevent the integral handle and rotor unit from being removed from the line base when the integral handle and rotor unit is in a position other than the predetermined position.

11. The electrical switching assembly of claim 2, wherein the rotor portion includes an extension opposite the handle portion, wherein the line base includes a bore, and wherein the extension is received in the bore.

12. The electrical switching assembly of claim 1, wherein the integral handle and rotor unit is made of an insulating material.

13. The electrical switching assembly of claim 1, further comprising an enclosure including an interior and an opening between the interior and an exterior of the enclosure, wherein a line base is within the interior, wherein the rotor portion is received within the opening, and wherein the handle portion is exterior to the enclosure.

14. An electrical switching assembly comprising:

an enclosure including an interior and an enclosure opening extending between the interior and an exterior of the enclosure;

an integral handle and rotor unit including a rotor portion integral with a handle portion, the rotor portion being received in the enclosure opening;

one or more conductors extending radially through the rotor portion;

one or more orientation features on the rotor portion;

a line base within the interior of the enclosure including one or more line base openings configured to receive the one or more orientation features when the integral handle and rotor unit is oriented in a predetermined position relative to the line base, wherein the rotor portion is configured to be rotatable about a central axis when the rotor portion is received within the one or more line base openings, wherein the one or more orientation features are configured to retain the rotor portion within the line base without needing any additional retaining mechanisms in the electrical switching assembly; and one or more terminals in the line base, wherein the one or more terminals are configured to contact the one or more conductors in response to rotation of the integral handle and rotor unit.

15. The electrical switching assembly of claim 14, wherein the one or more orientation features includes one or more lobes extending from the rotor portion.

16. The electrical switching assembly of claim 15, wherein one or more lobes extend further from the rotor portion than other elements of the rotor portion.

17. A method of assembling a switching assembly, comprising:

providing an integral handle and rotor unit including a handle portion integral with a rotor portion, the rotor portion including one or more holes extending through the rotor portion;

providing a line base comprising one or more openings configured to receive the rotor portion;

providing one or more orientation features on the rotor portion, wherein the one or more orientation features enable the rotor portion to be received within the line base when the rotor portion is in a predetermined orientation relative to the line base and wherein the one or more orientation features are configured to retain the rotor portion within the line base without needing any additional retaining mechanisms in the switching assembly;

providing one or more electrical terminals within the line base;

rotating the rotor portion to a first position, wherein the rotor portion is receivable in the one or more openings when the rotor portion is in the first position;

inserting the rotor portion into the line base; and inserting a conductor into at least one of the one or more openings in the rotor portion, wherein each conductor is configured to electrically contact the one or more electrical terminals in response to rotation of the rotor portion.

18. The method of claim 17, further comprising rotating the rotor portion to a second position prior to inserting a conductor into at least one of the one or more openings in the rotor portion.

19. The method of claim 17, further comprising:

providing an enclosure; and affixing the line base within the enclosure.

20. The method of claim 19, wherein providing an enclosure comprises providing an enclosure including an enclosure opening between an interior of the enclosure and an exterior of the enclosure, and further comprising inserting the rotor portion through the enclosure opening.

* * * * *